United States Patent [19]

Carter

[11] Patent Number: 4,947,620

[45] **Date of Patent: * Aug. 14, 1990**

[54] METHOD OF PACKAGING AND STERILIZING A PHARMACEUTICAL PRODUCT

[75] Inventor: Douglas V. Carter, Lenoir, N.C.

[73] Assignee: Entrauision, Inc., Lenoir, N.C.

[ * ] Notice: The portion of the term of this patent subsequent to Feb. 21, 2006 has been disclaimed.

[21] Appl. No.: 273,605

[22] Filed: Nov. 21, 1988

Related U.S. Application Data

[63] Continuation of Ser. No. 137,436, Dec. 23, 1987, Pat. No. 4,805,377.

[51] Int. Cl.[5] ..... B65B 55/02

[52] U.S. Cl. ..... 53/425; 53/449

[58] Field of Search ..... 53/167, 415, 425, 449, 53/453, 421, 471

[56] References Cited

U.S. PATENT DOCUMENTS

| | | | |
|---|---|---|---|
| 2,004,079 | 6/1935 | McManus | 53/421 |
| 2,467,588 | 8/1984 | Carveth | 53/449 X |
| 4,805,377 | 2/1989 | Carter | 53/415 |

*Primary Examiner*—John Sipos

*Attorney, Agent, or Firm*—Rhodes, Coats & Bennett

[57] ABSTRACT

A method of filling, sealing and sterilizing a pharmaceutical package including a polypropylene bottle containing a balanced salt solution includes the steps of filling each bottle to maximum capacity to exclude residual air, the introduction of a silicone rubber gasket into the bottle cap to absorb pressure and prevent leakage during a steam sterilization procedure, and the enclosure of the filled bottles in a blister pack before steam sterilizing. The blister packs have Tyvek™ lids and are placed blister-side-up during the sterilization process to eliminate deformation of the blister during sterilization. Maximum filling of the bottle with liquid and the substantial elimination of air prevents dimpling of the bottle.

10 Claims, 1 Drawing Sheet

METHOD OF PACKAGING AND STERILIZING A PHARMACEUTICAL PRODUCT

REFERENCE TO RELATED APPLICATION

This application is a continuation of applicant's pending application, Ser. No. 137,436, filed on Dec. 23, 1987 now U.S. Pat. No. 4,805,377.

BACKGROUND AND SUMMARY OF THE PRESENT INVENTION

The current state of the art in the provision of balanced salt solutions and saline solutions of the type used in surgical procedures is generally to package the solution in a polyethylene squeeze bottle which includes an adapter that receives an irrigation cannula. The bottles must be sterilized internally and externally and are packed individually in a preformed blister pack which is sealed with a Tyvek TM lid. Because low-density polyethylene melts at approximately 100° C. it cannot be heat sterilized (heat sterilization requires a minimum of 121° C.). Therefore, the common practice is to aseptically fill the polyethylene bottles with a sterile solution, pack and seal the filled bottles in the blister packages, and expose each package to sterilization by ethylene oxide gas. Polyethylene is permeable to ethylene oxide and the above process results in some build-up of the gas in the sterile saline solution. When there is such a build-up, a chemical reaction takes place which results in the formation of ethylene glycol and ethylene chlorhydrin, both of which are potentially dangerous irritants that are highly undesirable in eye or other surgical irrigation solutions.

There have been some attempts to create a steam-sterilized package for saline solutions, but most of the known attempts have been commercially unsuccessful. One of the attempts which did receive some commercial recognition was a steam-sterilized process, but because of the special handling required by steam-sterilization the resulting product was a package that did not resemble the preferred squeeze bottle.

The present invention is a method of filling and sterilizing an improved squeeze-type bottle which is packaged in a blister pack sealed with a Tyvek TM lid before being subjected to a steam-sterilizing procedure. Polypropylene was the chosen material because it is known that polypropylene lessens the transport of ethylene oxide into the sterile solution. Additionally, although the polypropylene does expand and contract during the sterilization process and is known to soften to some extent at 121° C., applicant has found that by using certain novel procedures in the filling and sterilization stages, a highly improved package and product which overcomes substantially all of the shortcomings and disadvantages to known processes is obtained.

In addition to the use of polypropylene for the bottle and the cap, one of the novel steps in the present process is the introduction of a resilient silicone gasket or washer which is inserted into the threaded screw-type cap such that the gasket is positioned between the cap and the bottle top to absorb pressures which develop by expansion of the bottle and/or the cap. By absorbing these pressures, the silicone gasket prevents any deformation of the cap, of the cannula adapter, or the bottle, and substantially eliminates any leakage of the sterile fluid from the bottle during sterilizing. Although other rubber products might be used to form the gaskets, silicone is preferred because it is a pharmaceutically and medically accepted material known to be non-toxic.

Another novel step in the process includes the use of a preprinted, self-adhesive backed polyester label that is applied to the bottle approximately twenty-four or more hours prior to the filling and sterilizing processes. The labels are designed such that they extend no more than two-thirds of the circumference of the bottle because it has been found that wrapping the label any further around the bottle results in creasing and crinkling of the label. Further, it has been found that when the labels are placed on the bottles at least twenty-four hours prior to filling and sterilizing, the labels demonstrate a marked improvement in adhesion to the bottle.

With regard to the use of the polycarbonate blister pack sealed to a Tyvek TM lid, the use of these products in a package which is going to be subjected to steam-sterilization requires certain modifications to the sterilization operation. Polycarbonate is known to soften during application of heat and it has been found that the weight of the filled bottle is sufficient to cause the polycarbonate blister to deform and on occasion to cause the Tyvek TM seal to pop open. However, applicant has discovered that by placing the packages blister-side-up in the sterilization trays, the weight of the bottle is eliminated from the blister and thereby avoids damaging to the blister while the package is in the sterilization tray. The trays which are used during the sterilizing process are preferred to be a stainless steel wire mesh. The wire mesh is desirable in order to drain away as much of the condensed water as possible and stainless steel is preferred because of the ease of sterilizing the non-corrodable trays. When water does not drain away, the Tyvek TM seals do not tolerate long immersion and break away from the polycarbonate blister. Further treatment to the Tyvek TM involves the "zone-coating" of adhesive in the area where the Tyvek TM is in contact with the polycarbonate blister. By eliminating adhesive coating from the entire free portion of the Tyvek TM surface (that portion not in contact with the blister pack), the porosity of the Tyvek TM is not damaged and steam and air can flow into and out of the blister pack during the sterilization procedure.

DESCRIPTION OF THE PREFERRED PROCESS

Figure 1:
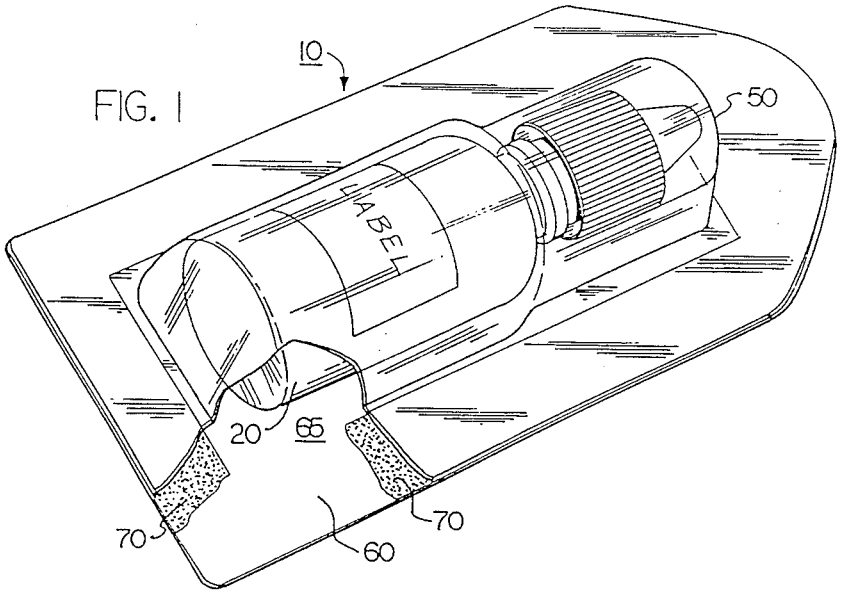
FIG. 1 is a perspective view, with parts broken away, of the pharmaceutical package described herein.
Figure 2:
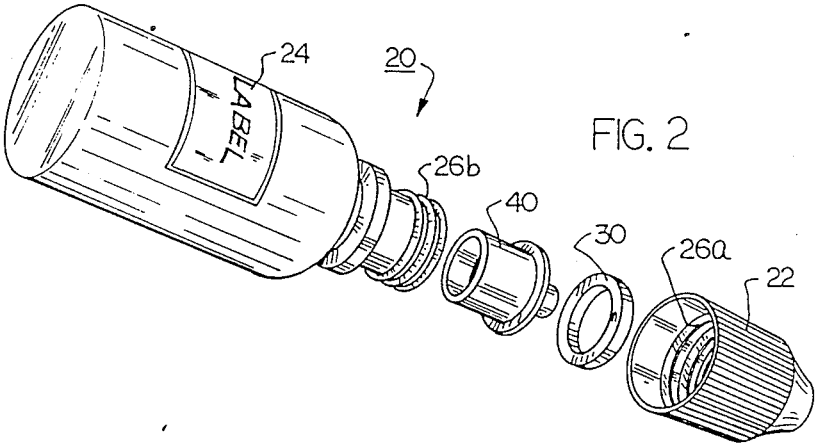
FIG. 2 is an exploded perspective view of the bottle shown in FIG. 1.

The preferred method of preparing and sterilizing the pharmaceutical package 10 described above is comprised generally of the following steps. The bottles 20 which are being filled are preferably of a semi-rigid squeeze-type nature and are preferably made of a polypropylene material. The lids or 22 caps are also preferably formed of polypropylene, although it is recognized that there are other polymeric materials which might be suitable for the bottles and the caps. It is also recognized that while the present application is generally directed to the preparation of a sterile saline solution package, the process described herein might be found suitable for use in preparing other types of pharmaceutical packages. Where other pharmaceuticals and solutions are contained, bottles formed of materials other than the herein described polypropylene might be preferable if the materials are more compatible with the product contained therein.

The initial step in the preferred process is preparing a plurality of polypropylene bottles 20, or bottles compatible with the product being contained therein, by applying labels 24 to each of the bottles. It is preferred that the chosen labels be applied to the bottles a minimum of twenty-four hours prior to the filling and sterilization process. Application of the labels 24 many hours in advance improves the adhesion of the label to the bottle before it is exposed to the steam-sterilization process. The preferred label 24 is a self-adhesive-backed polyester label of a width sufficient to extend approximately two-thirds around the outer circumference of the bottle. When the label extends more than two-thirds around the bottle, it has been found that the label is subject to wrinkling and creasing of the label when the steam-sterilization is applied. While it is possible that the label might extend less than two-thirds around the circumference of the bottle, it is preferred that it extend no more than two-thirds. Polyester labels are of the type preprinted with the required identifying information thereon, according to conventional method.

The next step in the process is the preparation of the polypropylene caps for each of the bottles. The caps are preferably of a threaded (as at 26*a*, 26*b*) screw-type in an appropriate size. Preparation is carried out by the insertion of a silicone rubber gasket 30 or washer into the top of the cap. While it is possible to place the washer on the bottle and screw the cap down onto the bottle and the washer, this approach has found to result in a higher rate of defective packages. As mentioned above, other rubber or polymeric materials might be used to form the washer or the gasket 30, but it is known that silicone is an acceptable material in medical and pharmaceutical products because silicone is non-toxic. It is critical that any other material which might be selected for use be non-toxic and non-degradable during a steam-sterilization procedure.

In processes that have been used previously, it was found that polypropylene undergoes significant expansion and contraction during the sterilization process. This increased the likelihood of loose caps and leakage of material out of the bottle at the end of the processing.

The introduction of the rubber gasket between the screw-cap and the bottle absorbs pressures developed by expansion and contraction and prevents deformation of the cap 22, the cannula adapter 40, or the bottle 30 and substantially eliminates any problems with leakage. After the bottles are labeled and the caps prepared, the uncapped bottles are placed in an upright position in a tray preparatory for filling. In the average packaging operation, as many as several hundred of the bottles are placed in each of the trays and moved from the labeling area to the filling area. At that point each of the bottles is individually filled to the maximum point—even to the creation of a slight overflow. Filling to a maximum degree eliminates air being trapped in the bottle. Where air is retained in the bottle after filling and capping, which is a problem typical with prior art processes, the trapped air will expand and can produce a pressure greater than the over pressure created during the steam-sterilization cycle. This pressure causes an expansion of the softened polypropylene bottle. After the bottle cools, the expanded areas form dimples to a degree which is directly related to the amount of air in the bottle. In the present process the elimination of trapped air in the bottle eliminates the dimpling factor.

After filling, the trays of bottles are moved to a location where a plug-type adapter 40 is inserted into the neck of each bottle. Insertion of the adapter 40 (used as a cannula or for receiving a connecting cannula) forces out excess liquid but leaves the bottle totally full. After the adapters are inserted, one of the prepared caps with the silicone washer therein is placed on each of the bottles and tightened by conventional method. The bottles are then externally rinsed and dried and inspected for defects.

The filled and capped bottles are then placed in a polycarbonate blister 50 of a conventional type, and the blister is sealed with a non-woven textile material lid 60. The lids on seals 60 are placed on the blisters by use of a "zed" lidding machine of a conventional type. However, the non-woven textile material, Tyvek TM, forming the lid 60, is not coated all over with an adhesive to seal it to the blister pack. Rather, the adhesive, or coating material illustrated at 70, is applied only to the area of the lid 60 which will be in contact with the polycarbonate blister. The uncoated, center portion of the lid is necessary to allow permeation of the lid by steam and air during the steam-sterilization. To further improve the movement of steam and air into and out of the packages, the sealed packages are placed in stainless steel, wire mesh sterilizing trays. The wire mesh permits the condensed water from the steam cycle to drain away and thereby improve the drying time of the packages and protect the seal from opening due to excess moisture. When the packages are placed in the sterilizing trays, they are placed blister-side-up in order to eliminate the weight of the bottle from the polycarbonate blister. When the packages are placed with the blister down and the weight of the bottle on the blister, the weight of the bottle is sufficient to deform the softened blister, frequently to the point where the seal opens. A further problem with placing the blister downward is the fact that as the air cools in the package the cooler air does not diffuse upwardly through the Tyvek TM lid. The use of the present process, however, allows the water to flow through the wire mesh tray and area 65 of the cooler air within the package to diffuse through the non-woven material which is not coated beyond the area of contact to the polycarbonate blister.

After the packages are arranged in the wire mesh trays, the trays are inserted in the autoclave where they are sterilized by use of an overpressure, steam-sterilization technique. An overpressure feature in a sterilization cycle is a technique wherein compressed air is introduced into the autoclave system at a level of approximately twenty-five psi to thirty psi while maintaining the steam temperature at approximately 121° C. A fan is also used in the autoclave to ensure total mixing of air and steam. While this system has been used for sterilization of other types of packages, it is previously unknown for use with semi-rigid, squeeze-type bottles. The sterilization process is continued on an automatically controlled basis for a predetermined time period. After sterilization is complete, the trays of packaged bottles are withdrawn and placed in a drying room for several hours. At the end of the drying period the individual packages are inspected for defects and are then stamped with lot numbers and expiration dates. Packages are then packed into crates or cartons and are ready for shipping and distribution. Obviously, samples are taken throughout the process and the sample materials subjected to full analyses for sterility and pyrogen tests to ensure that quality and F.D.A. standards are complied with. While a preferred embodiment of the process has been described above, it is not intended to limit the invention which is defined in the claims below.

WHAT IS CLAIMED IS:

1. A method of preparing and sterilizing a pharmaceutical package comprising a semi-rigid squeeze-type bottle containing a selected pharmaceutical liquid product, said method including the steps of:

(a) filling a resilient polymeric bottle with the selected pharmaceutical product to the point that said bottle is filled to capacity so as to eliminate any residual air in the bottle or the bottle neck, said bottle formed of a material that will withstand sterilizing temperatures of 121° C. without deforming and with substantially no leakage of vapor through the walls thereof;

(b) inserting a plug-type cannula adapter in the neck of each bottle while forcing out excess liquid and maintaining the bottle completely filled, said adapter being of the type used for connecting the pharmaceutical package to a cannula or other such medical apparatus;

(c) capping the bottles with a cap and inserting a washer formed of a non-toxic, resilient material between the inner surface of the top wall of the cap and the rim of the bottle to absorb pressures developed by expansion of said bottle and prevent deformation of the cap and bottle during subsequent steam-sterilization, thus eliminating leakage therebetween;

(d) forming a package by inserting said bottle into an individual blister pack formed of a prescribed polymeric material suitable for use in a steam-sterilization procedure and sealing said blister pack along the open side thereof with a closure lid made from a non-woven textile material having the characteristics of being steam-permeable and capable of withstanding and remaining sealed to said polymeric material during a steam-sterilization procedure;

(e) sterilizing said package at temperatures of at least 121° C. and pressures of greater than 15 pounds per square inch.

2. The method according to claim 1 wherein the filling step is conducted on a translucent bottle.

3. The method according to claim 1 wherein said filling step is conducted on a polypropylene bottle.

4. The method according to claim 1 wherein the capping operation includes the use of a cap formed of the same material as said bottle.

5. The method according to claim 3 wherein the capping operation includes the utilization of a cap formed of polypropylene.

6. The method according to claim 1 wherein the capping operation includes the insertion of a washer formed of silicone rubber.

7. The method according to claim 1 wherein the step of forming the package includes inserting the bottle into a blister pack formed of a polycarbonate material.

8. The method according to claim 1 and further including a preliminary step of applying a polyester label having prescribed identifying indicia printed on the inner surface thereof extending a prescribed distance around the circumference of said bottle.

9. The method according to claim 8 wherein said prescribed distance is no more than two-thirds around the circumference of the bottle.

10. The method according to claim 1 wherein said sterilizing step includes the placing of said package, blister side up, in a wire mesh sterilizing tray whereby said bottle is supported by the non-woven material, rather than by the polymeric material.

* * * * *

UNITED STATES PATENT AND TRADEMARK OFFICE

CERTIFICATE OF CORRECTION

PATENT NO. : 4,947,620

DATED : August 14, 1990

INVENTOR(S) : Carter

It is certified that error appears in the above-identified patent and that said Letters Patent is hereby corrected as shown below:

On the title page in item [73]: "Entrauision" should read --Entravision--

Signed and Sealed this

Eighth Day of January, 1991

*Attest:*

HARRY F. MANBECK, JR.

*Attesting Officer*

*Commissioner of Patents and Trademarks*